US009115520B2

(12) United States Patent
Eyme

(10) Patent No.: US 9,115,520 B2
(45) Date of Patent: Aug. 25, 2015

(54) PARTITION SYSTEM AND TRACK SUPPORT

(71) Applicant: Florian Eyme, Lyons (FR)

(72) Inventor: Florian Eyme, Lyons (FR)

(73) Assignee: Dynamic Hive, Inc., Columbia, MD (US)

( * ) Notice: Subject to any disclaimer, the term of this patent is extended or adjusted under 35 U.S.C. 154(b) by 0 days.

(21) Appl. No.: 14/258,724

(22) Filed: Apr. 22, 2014

(65) Prior Publication Data

US 2014/0338285 A1 Nov. 20, 2014

Related U.S. Application Data

(60) Provisional application No. 61/824,470, filed on May 17, 2013.

(51) Int. Cl.
*E05D 15/12* (2006.01)
*E05D 15/06* (2006.01)

(52) U.S. Cl.
CPC ..... *E05D 15/066* (2013.01); *Y10T 16/379* (2015.01)

(58) Field of Classification Search
CPC ..... E05D 15/12
USPC ..... 52/745.15, 481.2, 243, 243.1, 281; 16/96 R
See application file for complete search history.

(56) References Cited

U.S. PATENT DOCUMENTS 3,423,897 A * 1/1969 Birum, Jr. ..... 52/773
5,117,601 A * 6/1992 Habicht ..... 52/281
6,035,600 A * 3/2000 Habicht et al. ..... 52/717.02
6,202,382 B1 * 3/2001 Conterno ..... 52/762
6,374,456 B1 * 4/2002 Fort et al. ..... 16/96 R
6,634,149 B2 * 10/2003 Cates et al. ..... 52/283
7,065,929 B2 * 6/2006 Manzella et al. ..... 52/204.1
8,061,103 B2 * 11/2011 McMahon ..... 52/582.2
8,176,709 B2 * 5/2012 Siodla ..... 52/800.13
8,584,317 B2 * 11/2013 Liebscher et al. ..... 16/91
2009/0241445 A1 * 10/2009 Sprague ..... 52/243.1
2010/0251644 A1 * 10/2010 Quesada ..... 52/215

FOREIGN PATENT DOCUMENTS

FR 2913704 A1 * 9/2008 ..... E04B 2/74

* cited by examiner

*Primary Examiner* — Mark Wendell
*Assistant Examiner* — Keith Minter
(74) *Attorney, Agent, or Firm* — Ober, Kaler, Grimes & Shriver; Royal W. Craig

(57) ABSTRACT

A system and apparatus for construction interior partitions including a generally U-shaped horizontal track profile including a horizontal base extending to outside rails, a central channel in which to receive a shim and/or panel element and opposing channels in which to secure a gasketed panel retainer. Vertical framing elements at each end of a partition likewise provide side mounted channels with a cooperative channel in which a panel retainer may be secured. With track and framings in place the panel retainers on a first side are installed followed by the panel elements, optionally butt-jointed, and finally the opposing panel retainers. Additionally, a track support element and fastener catch is disclosed to allow a side-mounted sliding door track or other component to be face mounted (screwed) directly therein.

4 Claims, 5 Drawing Sheets

PARTITION SYSTEM AND TRACK SUPPORT

CROSS-REFERENCE TO RELATED APPLICATION(S)

The present application derives priority from U.S. Provisional Patent Application 61/824,470 filed 17 May 2013.

BACKGROUND OF THE INVENTION

1. Field of the Invention

The present invention relates generally to partitioning systems for interior spaces and more specifically to an adaptable partitioning system capable of supporting heavy and operative panels.

2. Description of the Background

Division of interior spaces in office buildings, convention halls and the like is a common need. The use of light weight assemblies of extruded aluminum shapes as a framework to construct partitions to divide such spaces is well known. Such assemblies are more or less mechanically "integrated" with the structural elements of the building, integrated being herein defined as fastened to some extent to the surrounding building such as an overhead bulkhead, or flanking drywall.

For example, the system may be fastened lengthwise at the top to an overhead bulkhead, ceiling or other structure, and this helps to increase the structural strength of the assembly including its ability to support heavy partition panels. However, the structural elements of the building are not always cooperative. As a result, it may only be possible to fasten the system intermittently at certain points or in very short lengths along the top, or minimally only along its sides at both ends. As the external structural support of the building is reduced so too is the total load-bearing capacity of the system, and the inherent capacity of the system alone must suffice.

Such lightweight, extruded aluminum frame systems cannot readily support heavy panels, panes of tempered glass, heavy doors, or other partitioning components that impose dynamic loading conditions. For example, heavy glass panes such as track mounted rolling doors pose a particular problem. An optimal solution would have sufficient inherent load-bearing capacity for an entire range of possible configurations so as to provide ample structural support in all such cases.

Previous attempts to overcome these deficiencies have led to more rigid track systems. However, such rigid track systems are incapable of accommodating even minor variation in floor surface conditions as are common in modern poured concrete floors. Absent an unrealistically flat floor surface, prior art systems place a deformable filler piece beneath the rigid track to conform to the floor surface. Thus unduly increases the cost and complexity of the installation process.

What is needed is a space partitioning system that is capable of supporting heavy and/or operable panels in and throughout a range of partially-integrated or fully-integrated configurations, and which additionally has the ability to conform to any irregularities in a floor surface without the need for additional, pliable components or sealant.

SUMMARY OF THE INVENTION

It is, therefore, an object of the present invention to provide a system and method of partitioning interior spaces by a partitioning system capable of supporting heavy operative wall panels. The system utilizes a horizontal track profile preferably formed of extruded aluminum and having a horizontal base portion extending upward at distal rails to form an open U-shaped element. Within the U shape is a central longitudinal channel flanked on either side by a channels formed between a protruding trim stop and protruding channel side wall. A cooperative panel retainer having a pair of spacer arms extending downward from a top portion closes one side of the U-shaped channel, the spacer arms being secured within the channel of the track profile by a clip periodically secured there along the length of the channel. The panel retainer seats a gasket in a longitudinal J-channel and presents the gasket in cooperative alignment with the central longitudinal channel horizontal track profile for engagement with a panel element such as a series of panes of glass inserted into the channel central longitudinal channel. With the panel element in place, a second, gasketed cooperative panel retainer is installed on the opposite side of the horizontal track profile to secure the panel element on both sides. A shim or similar element may be inserted into the central longitudinal channel to support and adjust the location of the panel element. The end of each run of panel elements terminates on a vertical framing member having a channel on each side. A vertical, gasketed panel retainer is retained in each of the channels of the framing member to engage and secure the panel members.

During installation, top and bottom track elements are aligned vertically with the open "U" shapes facing one another and the framing members are secured within the track elements at the ends of each run. The bottom track is laid directly on and conforms to the floor surface and any irregularities therein so as not to require any additional element or step to accommodate the floor surface. The panel retainers are installed on one side of the partition-to-be and a shim is placed within the longitudinal channel of the bottom track element if necessary. The panel elements are then installed against the gaskets of the panel retainers by inserting the top edge first and then swinging the bottom edge under to rest on the shim. In this configuration, the top track element trim stop prevents the panel element from tipping out of the track. The opposing panel retainers are then installed and the panel thus secured in place.

Optionally, where it is desired to attach the top track element of the partition to an overhead, a track support may be provided for additional support of heavy or operative panel elements. The track support is in the form of a closed form, hollow rectangular member with two internal, vertically oriented, longitudinal stiffening fastener catches which provide additional support to side mounted hardware such as a sliding door track. One or more alignment fins may also be provided extending from the lower surface of the rectangular member.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is an apparatus and system for constructing partition walls capable of supporting heavy and operative panel elements, accommodating variation in floor surface level, and still allowing for ease of assembly and reconfiguration as needs change.

Figure 1:
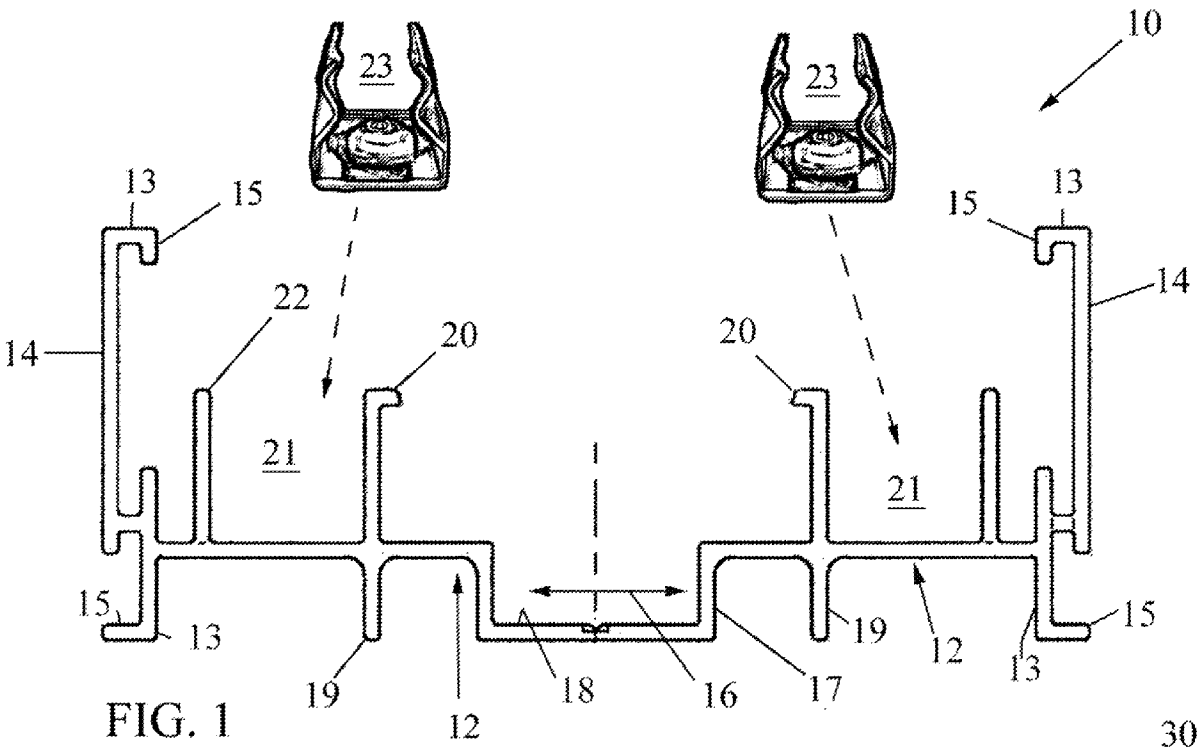
FIG. 1 is a cross sectional view of track profile according to the present invention.
Figure 2:
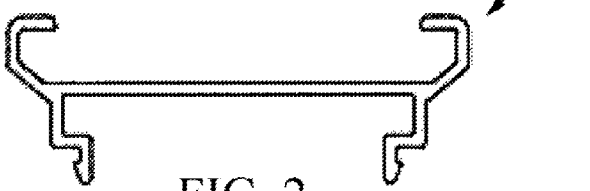
FIG. 2 is a cross sectional view of a widening adapter 90 according to the present invention.

With specific reference to FIG. 1, and general reference to FIGS. 2-5, an exemplary embodiment of the system and apparatus of the present invention includes a particular track profile 10 as shown (FIG. 1) to anchor each partition wall. In practice, both a top track profile 10 and identical bottom track profile 10 will be provided, one each at both the lower extremity of a partition wall (typically at the floor) and at the upper extremity of the partition wall (typically at the ceiling). The top track profile 10 may be attached to an overhead portion of the surrounding building structure such as a ceiling, dropped ceiling, bulkhead, joist, beam etc. However, one skilled in the art should understand that the overhead building elements need not be continuous and indeed the partition wall need not be full height. In such case the top track profile 10 may be intermittently attached overhead or minimally attached at both ends to the structure of the surrounding building. The bottom track profile 10 is typically in contact with the floor slab or other floor surface and is preferably mechanically affixed to the floor surface as by screws or the like. The top and bottom track profiles 10 are positioned in vertical alignment with one another and trace the horizontal path of the partition wall through and within the space to be divided.

Each track profile 10 is characterized by a generally U-shaped cross section open to one side (the upper side in the depicted embodiment), and with a plurality of projecting appendages as will be described. Track profile 10 is preferably symmetrically situated about a centerline (dotted). The U-shaped cross section is defined by a base member 12 which extends outward from a partition channel 16 at the centerline to side rails 14 situated at its distal ends. The side rails 14 extend generally orthogonally and typically perpendicularly to the overall plane of the base member 12, and cooperatively form opposing sides of the "U". The side rails 14 preferably extend upward a distance from one to three inches from the plane of the base member 12 to an optional trim-engaging element. In the illustrated embodiment the trim-engaging element comprises an inward flange 13 at the distal ends of side rails 14 presenting a flat surface parallel to the plane of the base member 12, and turned downward at a lip 15. It should be noted that the side rails 14 may terminate without a flange 13 and/or lip 15, or any other form of trim-engaging element.

Between the side rails 14, the base member 12 is preferably formed to include a partition channel 16 along its centerline. The partition channel 16 is preferably a drop-channel formed below the plane of the base member 12 by channel sidewalls 17 that extend downward from the plane to a channel bottom 18 as depicted, but may alternately be formed as an elevated channel by extending a pair of spaced sidewalls upward from the base member 12. When formed as a drop-channel, additional standoffs 19 are preferably provided on opposing sides of the center channel 16 to add support for the base member 12. The drop-channel embodiment is preferred because the base member 12 and center drop-channel 16 permit greater lateral flexibility and less contact area with any abutting surface (such as a floor) and better accommodate irregularities in that surface without the need for an additional element such as an elastomer.

Also provided on each side of the center channel 16 between the channel and side rails 14 is a trim stop 20 projecting upwardly from base member 12. In a preferred embodiment the opposing trim stops 20 are upward extensions of stand offs 19, and the demarcate channels 21 which serve to laterally align and longitudinally locate slide clips 23 (see overhead insets) which are screwed to the bottom of channels 21 for securing a trim panel therein as will be described. Each trim stop 20 is preferably provided in the form of a protrusion extending upward from the plane of the base member 12 a predetermined distance for cooperative, engagement with a trim element (not shown). An optional channel side wall 22 of commensurate height may also be provided as a second trim stop, spaced from trim stops 20, to demarcate the outer extent of channels 21. In practice, slide clips 23 (insets) are affixed within channels 21 to secure a panel retainer 30 in place (as described below) during assembly of the system. The panel retainers 30 slide into the channels 21 about slide clips 23 (see also, FIG. 8), and the clips 23 retain panel retainers 30 therein. The height of the channel 21 between side wall 22 and trim stop 20 above the plane of the base member 12 is necessarily less than that of the side rails 14.

Figure 3:
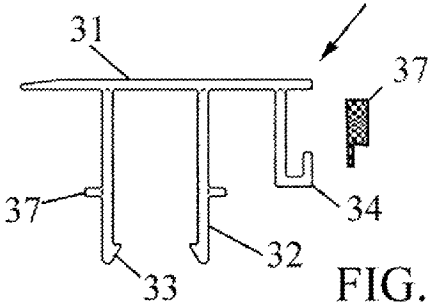
FIG. 3 is a cross sectional view of a trim element according to the present invention for use with the track profile of FIG. 1.

With reference to FIG. 3, a panel retainer 30 is provided for cooperative engagement with the track profile 10. The panel retainer 30 includes a top portion 31 intended to close off a portion of the open top of the U-shaped track profile 10 while also supporting from one side an inserted panel element, e.g., a conventional wall panel or partition. The top portion 31 may be a flat, planar surface or may be adorned for aesthetic purposes as desired. Extending downward from a bottom surface of the top portion 31 is at least one spacer arm 32 and preferably a pair of opposing spacer arms 32 spaced for cooperative alignment and slidable insertion within the channel 21 of the track profile 10 of FIG. 1. Each spacer arm 32 extends to a distal end tapered to a preferably rounded point extending to form an inward facing hook 33 which embraces slide clips 23 (FIG. 1 insets) to secure panel retainers 30 in track profile 10.

Figure 8:
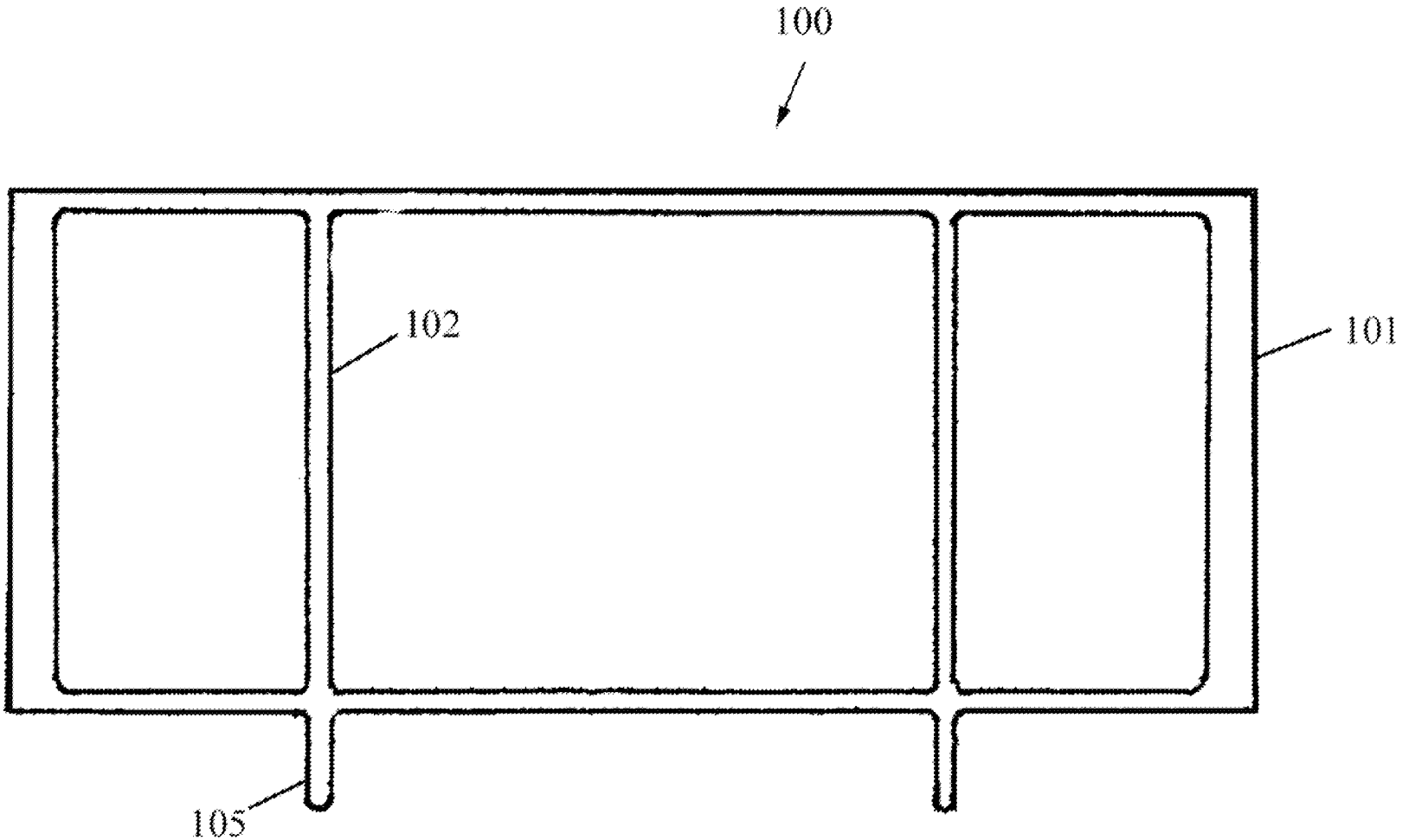
FIG. 8 is a cross sectional view of a track support 100 according to the present invention.

With reference to FIG. 8, when the panel retainer 30 of FIG. 3 is mated to the track profile 10 of FIG. 1, the outside surface(s) of the spacer arm(s) 32 engage the inside surfaces of the trim stop 20 and channel sidewall 22 to removably secure the panel retainer 30 in place without the need for additional tools or fasteners.

Referring back to FIG. 3 the outside surface of the spacer arm(s) 32 is provided with a rib 37 that engages the distal end of the trim stop 20 or channel sidewall 22 to limit the depth of engagement of the spacer arms 32 within the channel 21 so as to positively align the panel retainer 30 in its proper position, again without the need for an additional tool or particular care by the installer. Also extending downward from a bottom surface of the top portion 31 is a J-channel 34 or other suitable form in which to seat a foam or elastomeric gasket 37 (to provide a bumper for the panel element). In addition to seating the gasket 37, the J-channel 34 presents a larger surface area abutting the panel element so as to reduce any localized stresses.

Figure 4:
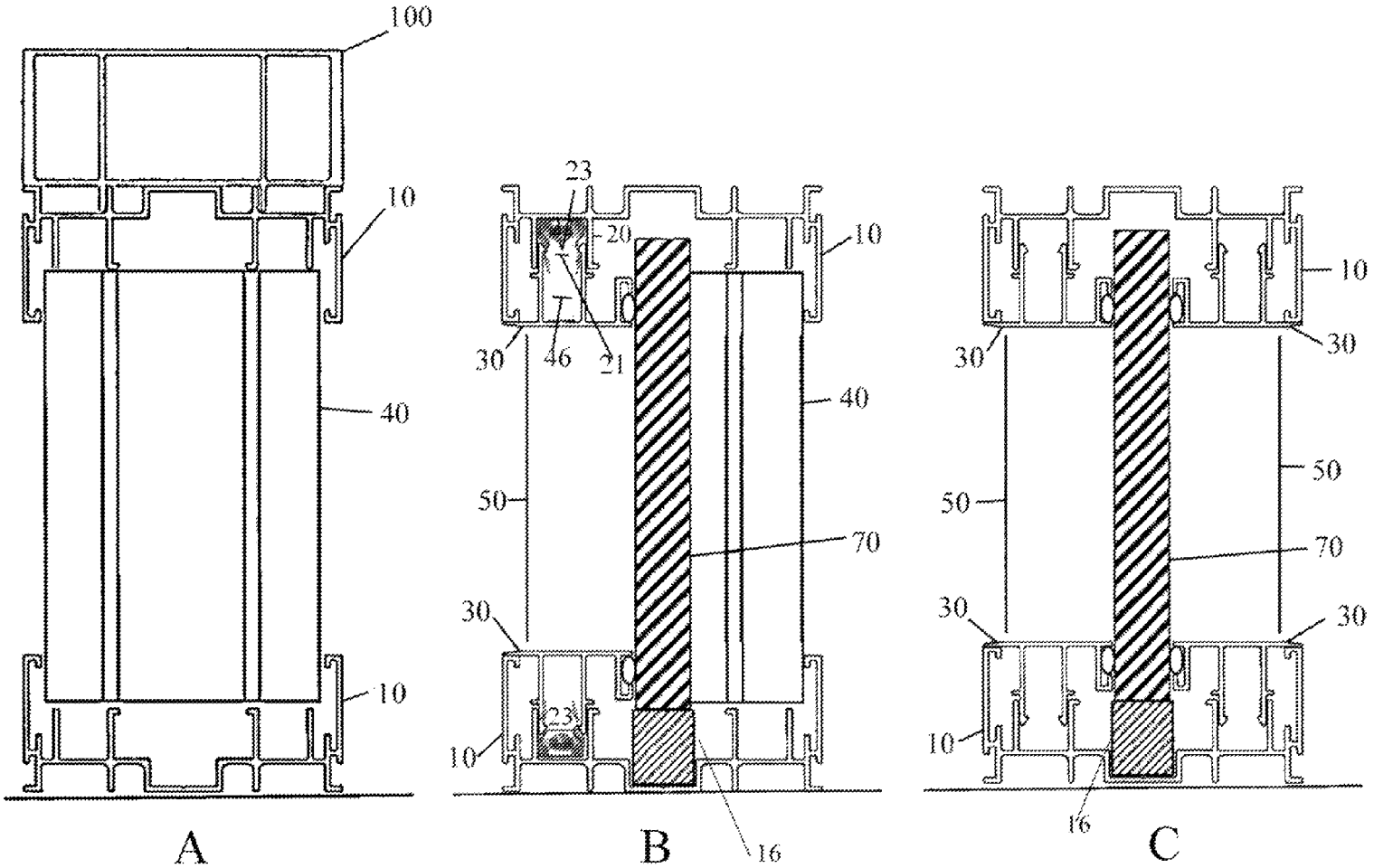
FIGS. 4(A-C) is a vertical section composite-series of the assembly steps of the method according to the present invention.

With reference to FIGS. 4(A-C), installation or assembly of a partition wall according to the present invention starts by securing a length of the track profile 10 on the floor of the space to be partitioned, along the path of the desired partition as at FIG. 4(A) bottom. As previously described, the track profile 10 may be typically secured to the floor mechanically as by screws or the like. Due to the cross sectional shape of the base member 10, the base member 10 will accommodate irregularities in the floor surface such as non-flat and non-level areas so that no elastomeric filler/sealer nor mechanical adapter is required between the base member 10 and the floor surface. Additionally, it is not necessary for the installer to take any steps to shim, level or otherwise modify the base member 10 relative to the floor surface. If the top of the partition is to be secured to the building structure, another length of track profile 10 is installed directly above lower track profile 10 with the open end of the "U" shape facing downward. As seen at FIG. 4(A) top, the top length of track profile 10 is secured to the building or ceiling structure by means suitable for the given structure as will be understood by one skilled in the art.

A framing member 40 as depicted in FIG. 4(A) middle is then installed between the top and bottom track profiles 10 running top to bottom alongside each run of panel elements. Framing members 40 will typically be secured to existing building drywalls at the beginning and end of the partition system run.

Figure 5:
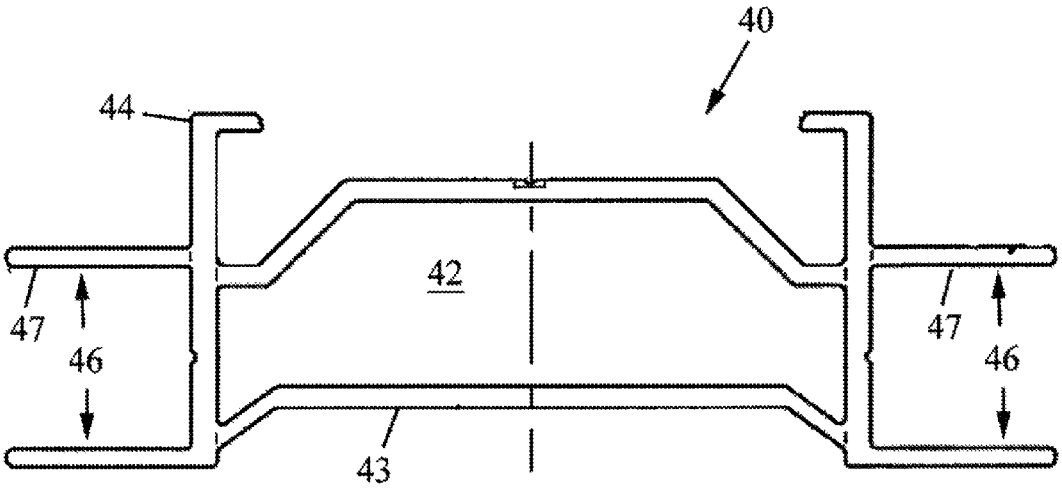
FIG. 5 is a cross sectional view of framing profile 40 according to the present invention.

With reference now to FIG. 5, a section view of the framing member 40 of FIG. 4 is depicted. The width of the framing member 40 is preferably selected to fit closely between the side rails 14 of the base member 10. In cross section, the framing member 40 is provided in the form of closed generally-rectilinear tubular member such as depicted in the figure defining a hollow central region 42. Central region 42 is preferably depressed toward the back of the framing, the back of the framing being the top side of the depicted image. A depressed wall 43 at the front of the framing 40 member provides a recessed exterior well into which a panel element may be received as will be described. The back side of the framing member 40 is preferably provided with a pair of standoffs 44 to hold the closed central region 42 away from and thereby accommodate irregularities in the surface to which it is secured. The framing member 40 may be secured mechanically as by screws or the like to a structural wall as in that of the building in which the partition is being erected or to another partition element such as, for example, an extruded aluminum corner post.

Each side of the framing member 40 is constructed to include a channel 46 defined by opposing flanges 47. As with the channel 32 of the base member 10, the channel 46 of the framing member 10 serves to laterally align and longitudinally locate slide clips 23 for securing a panel retainer 50 described below.

Figure 6:
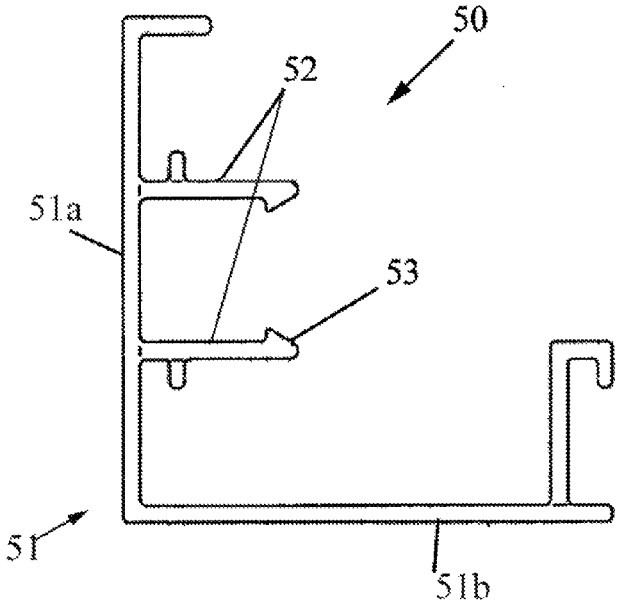
FIG. 6 is a cross sectional view of a trim element 50 according to the present invention for use with the framing profile of FIG. 5.

As seen in FIG. 6, a panel retainer 50 is provided for cooperative lengthwise engagement with the vertical framing member 40 to engage and support the panel element. The panel retainer 50 includes an outside portion 51 intended to enclose one side of the framing member 40 while also supporting from one side an inserted panel element. The outside portion 51 may be made up of two flat, planar elements 51*a*, 51*b* orthogonally arrange in an "L" shaped configuration or may be otherwise formed for aesthetic purposes as desired. Extending outward (as depicted) from an inner surface of the planar element 51*a* is at least one spacer arm 52 and preferably a pair of opposing spacer arms 52 spaced for cooperative alignment within the channel 46 of the framing member 10 (FIG. 1). Each spacer arm 52 extends to a distal end tapered to a preferably rounded point extending to form an inward facing hook 53 which slidably embraces slide clips 23 to secure panel retainer 50 in framing member 40.

Figure 7:
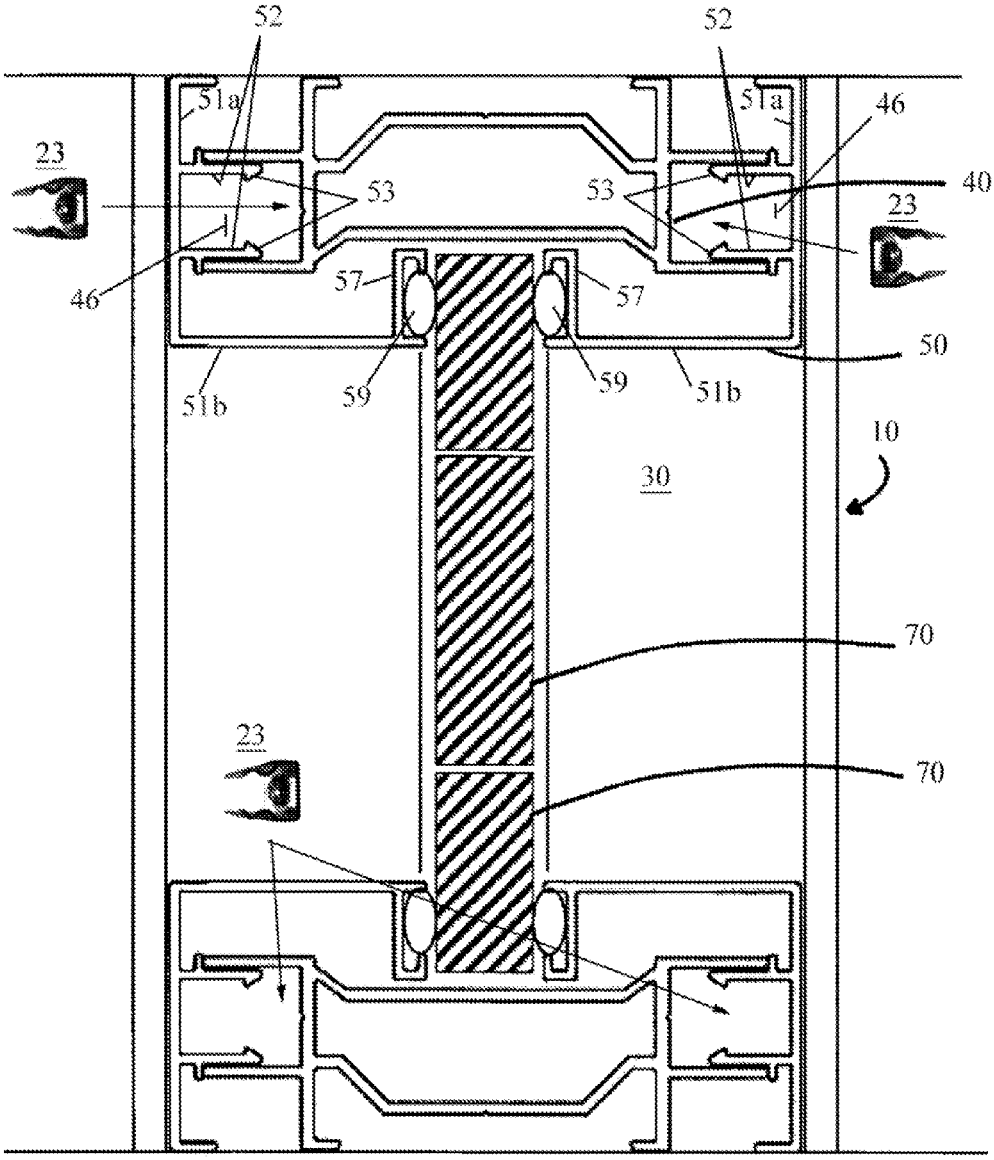
FIG. 7 is a horizontal section series of an assembly according to the present invention.

With reference to FIG. 7, when panel retainer 50 is mated to the framing member 40 the outside surface(s) of the spacer arm(s) 52 are engaged against the inside surfaces of the channel 46 while the hook(s) 53, as the case may be, interact with the slide clips 23 (FIG. 1 inset) within the channel 46 to removably secure the panel retainer 50 in place without the need for additional tools or fasteners. An outside surface of the spacer arm(s) 52 is provided with a protrusion 56 that engages the distal end of the channel 46 sidewalls to limit the depth of engagement of the spacer arms 52 within the channel 46 so as to positively align the panel retainer 50 in its proper position, again without the need for an additional tooling or particular care by the installer. Also extending from an inside surface of the planar element 51*b* of the outside portion 51 is a J-channel 57 or other suitable form in which to seat a foam or elastomeric gasket 59 against which to secure the panel element. Here again, in addition to seating the gasket 59 the J-channel 57 presents a wider surface area against which the panel retainer 50 can bear so as to reduce any localized stresses induced within the panel retainer 50.

With renewed reference to FIG. 4, installation or assembly of a partition wall according to the present, continues after securing the horizontal top and bottom track profiles 10 in vertical alignment along the path of the partition and further securing the vertical framing members 40 between the side rails 14 of the base member 12 at the end of each run of panels. If not installed prior to securing the track profiles 10 in place, retaining clips 23 are next periodically affixed within the channels 21, 46 of the track profiles 10 and framing members 40. The panel retainer 50 is installed in the framing members 40 on one side of the partition wall, and the panel retainer 30 is likewise installed on the same side of the top and bottom track profile 10. If not already in place, a resilient gasket 37, 59 is inserted into the J-channels 34, 59 of the installed panel retainers 30, 50 and a shim element 60 is next placed within the channel 16 in the bottom track profile. The shim element 60 is preferably an elastomeric or foam bumper strip having a rectangular cross-section.

As seen in FIGS. 4(B-C) a panel element 70 is next introduced. The panel element 70 is a generally planar element in the nature of a board or glass pane and may be opaque, translucent or transparent. The width of the panel element 70 is variable as a matter of design choice, typically from ⅜" to 1". The height of the panel element 70 is selected based on the ultimate height of the partition wall as determined by the vertical spacing between the top and bottom track profiles 10. The height of the panel element 70 is preferably selected to be greater than the distance between the top surface of the shim element 60 and the distal end of the trim stop 20 on the top track profile 10, and less than the distance between the top surface of the shim element 60 and the bottom of the channel 16 in the top track profile 10.

The panel element 70 is installed by inserting its top edge into the channel 16 of the top track profile 10 and then rotating the bottom of the panel element 70 under the top edge so that the panel 70 is in vertical alignment with the top and bottom track profiles 10 and engaged against the resilient gasket in the J-channels 34, 59 of the installed panel retainers 30, 50. The panel element 70 is then allowed to rest on the shim element 60. With the panel 70 height properly selected as described above, the trim stop 20 on the second side of the top track profile 10 serves as a safety stop at this stage. Even if the top edge of the panel element 70 were to tip away from the gasket, the panel element would not be permitted to fall to the ground as the top of the panel element 70 will be caught by the trim stop 20. Additional panel elements 70 are inserted in this manner along the length of the partition wall. Importantly, the panel elements may be butted directly against one another without the need for spacers or other intermediate members. With all of the panel members in place, the gasketed panel retainers 30, 50 are installed on the second side of the framing 40 and top and bottom track profiles 10 via the clips as described above to complete the installation.

In certain instances, such as where a door is desired, a panel element 70 may be omitted along the length of a partition. Likewise, the bottom track profile 10 may be omitted at the threshold across the door. The top track profile 10 may receive a widening adapter 90 as seen in cross section in FIG. 2 in order to accommodate a door system or to provide a finished aesthetic. The widening adapter 90 is intended to be snap-fit to the top track of an existing door way. Once installed on top of the door way, in the top track, the widening adapter 90 provides compatibility with peripheral components such as a door frame and swing or sliding door combination, or simply insertion of a trim cover plate to finish the bottom of the top track at the door way. The widening adapter 90 includes on one side a pair of clip elements adapted to engage the distal ends of the opposing trim stop 20 of the track profile 10. The opposite side provides a secondary U-shaped channel sized to fit within the side rails 14 of the track profile 10 for purposes described above.

Minimally, framing members 40 will be secured along their vertical lengths to existing building drywalls at the beginning and end of the partition system run. The upper track profile 10 (or other extruded aluminum element) may or may not be secured along some or all of its length to any portion of the building structure. Again, any unsupported length of the partition is limited by the strength of the material, the weight of the panel element 70 to be used and whether or not operative panels such as a track mounted sliding door panel are to be used. Where the unsupported span of the partition wall exceeds the capacity of the track profile 10, a track support 100 may be provided as depicted in FIG. 8. Typically, the track support 100 will be fastened to an overhead bulkhead. However, the track support 100 also allows fastening of face mounted sliding door systems or other peripheral components. Track support 100 provides a thick walled box formed beam element 101 with internal vertical fastener catches 102. While the fastener catches 102 add strength and rigidity strengthen the box formed beam element they also receive the distal end of fasteners such as screws driven through the outside walls of the box formed beam element to, for example, affix a side-mounted sliding door track to the side of the track support 100. Fasteners engaging the box formed beam element 101 at both the outside wall and the fastener catches 102 offer significantly more holding power than those which engage only the outside wall and fastener length should be selected accordingly. A pair of positive alignment fins 105 are provided on the lower surface the box formed beam element 101 parallel to the fastener catches 102 for positive alignment with additional elements such as the track profile 10.

It should now be apparent that the above-described method and apparatus effectively dampens the rebound of a lacrosse ball received in a head 10 pocket particularly one in which the webbing is strung taught according to the rules of the game. Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A system for installing an interior partition comprising:
an open-topped longitudinal track element having, in cross section:
a horizontal base portion disposed along a midline,
a first longitudinal channel formed in said base portion and centered on said midline,
at each distal end of said base portion, a longitudinal rail extending upward therefrom, and
between said first longitudinal channel centered on said midline and each said longitudinal rail, a first pair of appendages extending substantially parallel to said rail to define a second longitudinal channel between one of said first appendages and a corresponding one of said longitudinal rails; and
a longitudinal panel retainer having, in cross section:
a planar element for closing a portion of said open-topped longitudinal track element,
a second pair of appendages extending from said planar element, said appendages positioned to be received in one of said second channels when said planar element is closing a portion of said open-topped longitudinal track element, and
at one end of said planar element, a longitudinal track in which to receive a resilient member.

2. The system of claim 1 comprising two longitudinal panel retainers and a plurality of panel elements received between said two longitudinal panel retainers.

3. The system of claim 1 further comprising a vertical framing member at a longitudinal end of said track element, said framing member received between said rails and further comprising on each side of said midline, a pair of protrusions forming a vertical channel,
said system further comprising a vertical panel retainer having, in cross section:
a planar element for enclosing a portion of said framing member,
a third pair of appendages extending from said planar element, said appendages positioned to be received in said vertical channel when said planar element is enclosing a portion of said framing member, and
at one end of said planar element, a vertical track in which to receive a resilient member.

4. A method of installing an interior partition comprising:
securing to floor surface an open-topped longitudinal track element having, in cross section:
a horizontal base portion disposed along a midline,
a first longitudinal channel formed in said base portion and centered on said midline,
at each distal end of said base portion, a longitudinal rail extending upward therefrom, and
between said longitudinal channel centered on said midline and each said longitudinal rail, a first pair of appendages extending substantially parallel to said rail to define second and third longitudinal channels each between one of said first appendages and a corresponding one of said longitudinal rails; and
providing a first longitudinal panel, retainer having, in cross section:
a planar element for closing a portion of said open-topped longitudinal track element,
a second pair of appendages extending from said planar element, said appendages positioned to be received in said second channel when said planar element is closing a portion of said open-topped longitudinal track element, and at one end of said planar element, a longitudinal track in which to receive a resilient member, installing said first longitudinal panel retainer to said track element by inserting said second pair of appendages between said appendages defining said second longitudinal channel, inserting a resilient member in said longitudinal track of said first longitudinal panel retainer, positioning at least one panel element against said resilient member, providing a second longitudinal panel retainer having, in cross section:

a second planar element for closing a portion of said open-topped longitudinal track element, a third pair of appendages extending from said second planar element, said appendages positioned to be received in said third channel when said planar element is closing a portion of said open-topped longitudinal track element, and at one end of said second planar element, a longitudinal track in which a resilient member is received, and installing said second longitudinal panel retainer to said track element by inserting said third pair of appendages between said appendages defining said third longitudinal channel.

* * * * *